US008635821B1

(12) United States Patent
Pierce et al.

(10) Patent No.: US 8,635,821 B1
(45) Date of Patent: Jan. 28, 2014

(54) SAFETY LINE ANCHOR SECURABLE TO ROOF DRAIN

(76) Inventors: Michael C. Pierce, Lee's Summit, MO (US); Stephen M. Frogge, Raytown, MO (US)

( * ) Notice: Subject to any disclaimer, the term of this patent is extended or adjusted under 35 U.S.C. 154(b) by 0 days.

(21) Appl. No.: 13/550,053

(22) Filed: Jul. 16, 2012

(51) Int. Cl.

| | |
|---|---|
| ***E04B 1/70*** | (2006.01) |
| ***E04F 17/00*** | (2006.01) |
| ***E04D 13/00*** | (2006.01) |
| ***E02D 5/74*** | (2006.01) |
| ***E04B 5/48*** | (2006.01) |

(52) U.S. Cl.
USPC ..... 52/302.1; 52/11; 52/160; 285/42

(58) Field of Classification Search
USPC ..... 52/302.1, 302.7, 155–166, 698–715, 52/11–15; 285/42; 248/231.9, 231.91; 182/3, 45
See application file for complete search history.

(56) References Cited

U.S. PATENT DOCUMENTS

| | | | | |
|---|---|---|---|---|
| 1,120,411 | A | 12/1914 | Rohmer | |
| 1,807,488 | A | 5/1931 | Michalicek | |
| 3,017,000 | A | 1/1962 | Hynds | |
| 3,651,651 | A | 3/1972 | Triplett | |
| 4,716,674 | A | 1/1988 | Kammeraad | |
| 4,899,972 | A | 2/1990 | Cranko et al. | |
| 5,143,171 | A | 9/1992 | Glynn et al. | |
| 5,699,875 | A | 12/1997 | Dugan | |
| 5,758,742 | A | 6/1998 | Chiou et al. | |
| 6,779,316 | B2 | 8/2004 | Carroll | |
| 6,834,745 | B2 | 12/2004 | Vandelinde | |
| 2007/0257171 | A1 | 11/2007 | Reeves | |
| 2009/0007502 | A1 | 1/2009 | Roy et al. | |
| 2011/0048851 | A1 * | 3/2011 | Koneval | 182/3 |

* cited by examiner

*Primary Examiner* — Andrew Triggs
(74) *Attorney, Agent, or Firm* — Erickson, Kernell, Derusseau & Kleypas, LLC

(57) ABSTRACT

A safety line anchor securable to a roof drain is disclosed. The anchor provides a secure tie down location for people working on the roof of a building. The anchor is portable so that users can carry it with them to the roof and secure it in a roof drain with minimal modification of the drain. When the worker is finished on the roof, the device can be removed and carried away. The safety line anchor comprises a body, a drain coupling assembly, and an expansion assembly. The drain coupling assembly securely fastens the anchor to the roof drain. The expansion assembly expands in the neck of the drain or the roof drain system piping to minimize wobbling of the anchor. A safety line may be attached to the body of the anchor.

11 Claims, 6 Drawing Sheets

SAFETY LINE ANCHOR SECURABLE TO ROOF DRAIN

BACKGROUND OF THE INVENTION

1. Field of the Invention

This invention relates to safety line anchors that provide a secure tie down location for people working on the roof of a building or other elevated surface. More specifically, this invention relates to portable versions of such anchors that can be easily transported to and from each point of use.

2. Background & Description of the Related Art

Persons working on roofs or other elevated surfaces commonly utilize fall restraint and fall arrest systems to mitigate the chances of falling and injury. These fall restraint/arrest systems generally consist of an anchor, a tether or safety line, and some type of harness for attaching the tether to the worker. Examples of workers that would use these systems are contractors, roofers, custodians, and ventilation equipment technicians.

The present invention addresses the need for anchors for these systems to be portable and easily installed and removed on an as-needed basis. Roofs typically do not have permanent anchors installed, or if they do, the anchors are not in locations that would allow the anchors to be used in the new area of work. In such cases a new anchor must be installed, which takes additional time and expense above that already budgeted for the work. What is needed in the field of roof safety line anchors is a reusable anchor that can be carried to the jobsite, quickly installed where desired, reliably used in a fall restraint/arrest system, and easily removed when finished. Such a device is disclosed herein.

U.S. Pat. App. Pub. No. 2011/0048851 to Koneval, discloses a roof safety anchor that can be connected to the drain line of a roof drain system. However, Koneval relies solely on an expansion fitting to secure the anchor in the drain line which raises concerns about inadvertent release of the anchor. Also, Koneval's design requires the use of concentric spacers surrounding the stem of the device to fill the bowl of the drain to minimize wobble of the stem extending up through the bowl of the drain. This method of minimizing wobble is limited by the size of the spacers preinstalled on the device. In addition, because the spacers are of fixed diameters, the device must carry several different sizes due to the uncertainty of the roof drain size which will be encountered. By carrying a variety of spacers on the device unnecessary bulk and weight are added to the device. Furthermore, Koneval's device is intended to frictionally engage the interior walls of the "drain line" below the drain and not the drain neck or the portion of the drain piping within the neck area. This could be problematic if the anchor is intended to be used in a roof drain that has only a short segment of vertical drain pipe connecting to the drain. In such situations there may not be a sufficient length of drain piping below the drain to safely use Koneval's device. In view of the foregoing, there remains a need for a portable safety line anchor particularly well adapted for use on a roof including such an anchor which can be secured within or through a drain in a roof.

SUMMARY OF THE INVENTION

The present invention comprises a safety line anchor removably securable within a roof drain. The roof drain includes a neck connectable to a drain pipe, a bowl projecting outward from the neck, and a clamping flange projecting outward from the upper end of the bowl. The roof drain includes a plurality of bolt receivers formed in the bowl. A clamping ring connects to the bowl over the clamping flange by bolts extending into the bolt receivers in the bowl, and depending on roof construction the roof membrane is generally clamped between the clamping ring and the clamping flange.

The safety line anchor comprises a body having an upper end and a lower end. An expansion assembly is mounted on the lower end of the body, and prior to expansion the expansion assembly is sized to fit within the neck of the roof drain or within the drain pipe to which the neck is connected. The expansion assembly is expandable radially outward and sized to frictionally engage the inner surface of the neck or the drain pipe within the neck upon expansion.

The safety anchor further comprises a drain coupling assembly which includes a hub vertically adjustable relative to the expansion assembly. The drain coupling assembly includes a plurality of forks with each fork being adjustable outward relative to the hub. When the anchor is installed each fork will at least partially surround one of the bolts or bolt receivers of the roof drain. The anchor also includes a means for attaching a safety line to the anchor.

DETAILED DESCRIPTION OF THE PREFERRED EMBODIMENTS

Figure 1:
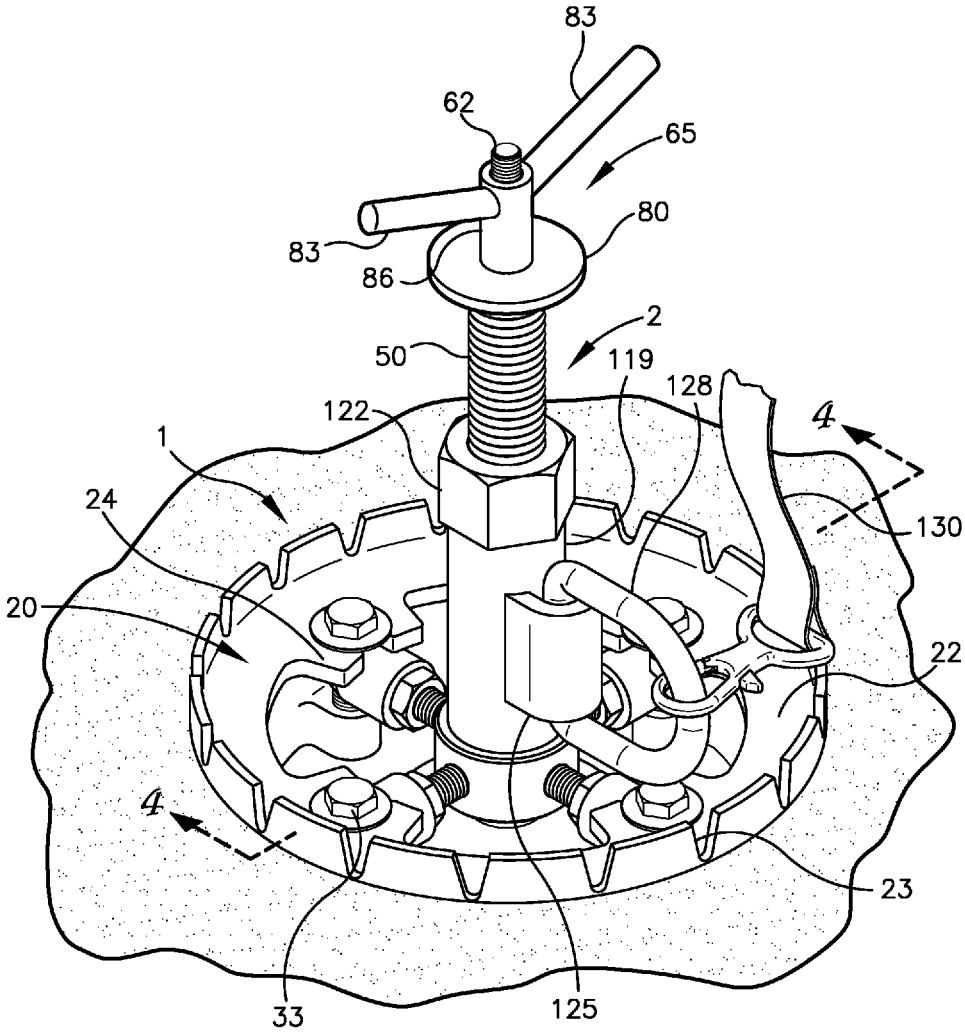
FIG. 1 is a perspective view of a safety line anchor securable to a roof drain shown installed in a roof drain.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 5:
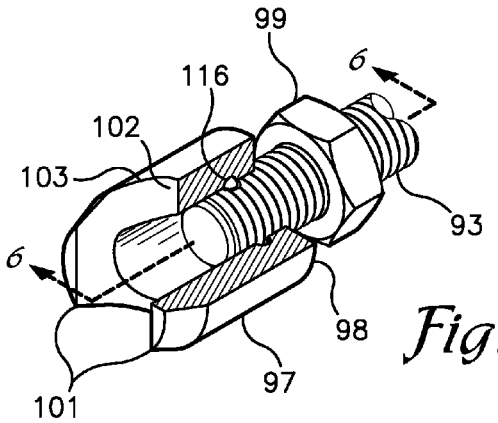
FIG. 5 is an enlarged and fragmentary perspective view of a bolt engaging member of the safety line anchor with portions removed to show interior detail.
Figure 6:
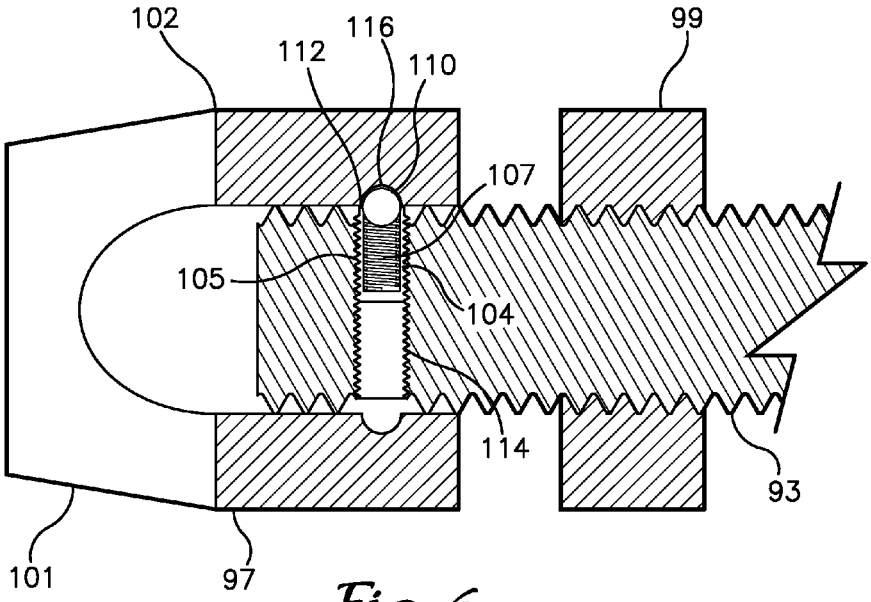
FIG. 6 is an enlarged and fragmentary cross-sectional view taken along line 6 of FIG. 5.
Figure 7:
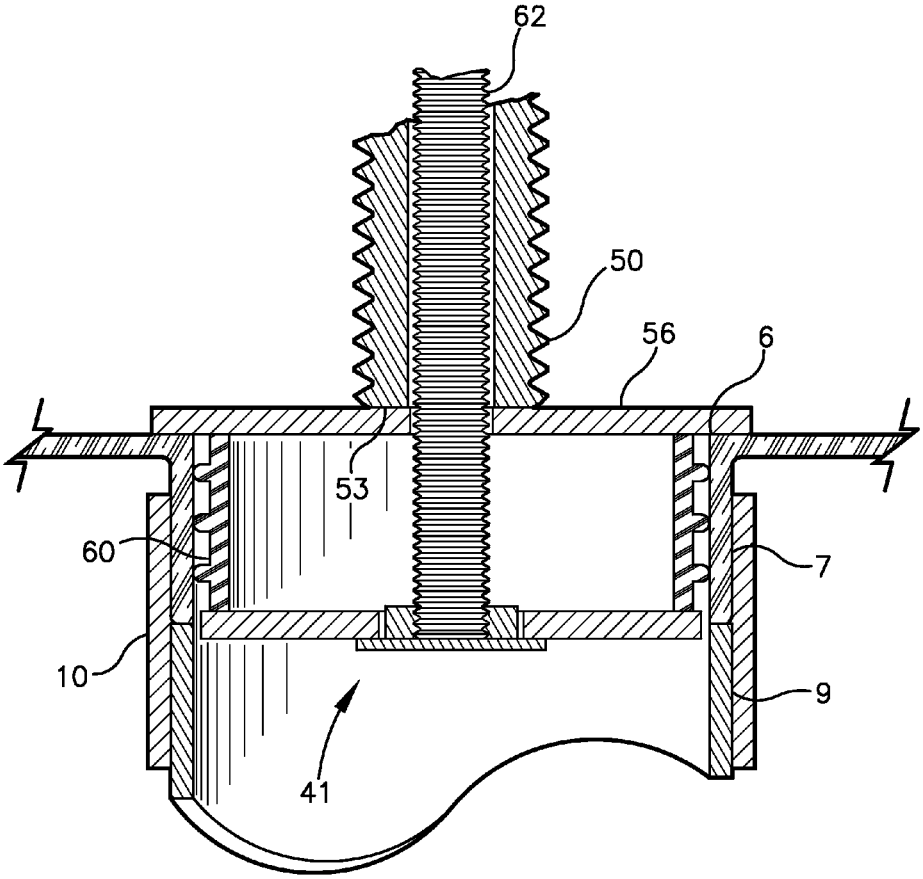
FIG. 7 is a cross-sectional, fragmentary view similar to FIG. 4 showing a neck of the drain extending in abutting relationship instead of overlapping relationship with a drain pipe.

Referring to the drawings in more detail, reference numeral 1 refers to a roof drain of a conventional design to which a safety line anchor 2 of the present invention may be attached. Roof drain 1 includes a bowl 4 that gathers and funnels water entering roof drain 1 toward a circular bowl opening 6 located in the center of the floor of bowl 4. Bowl opening 6 opens into an integrally formed cylindrical neck 7 which projects downward from the floor of bowl 4. Neck 7 is sized according to drainage requirements of the roof being served. Neck 7 is in flow communication with and mates with or abuts roof drain system piping 9. Referring to FIG. 5, the drain pipe 9 is shown inserted in neck 7. However it is to be understood that the safety line anchor 2 could be used with drains 1 in which the neck 7 is sized to be and is inserted into the open end of the drain pipe 9 or in which a lower end of the neck 7 abuts the upper end of the drain pipe 9 and an elastomeric sleeve 10 spans the joint between the neck 7 and drain pipe 9 as shown in FIG. 7.

Roof drain 1 further comprises an annular clamping flange 11 formed at the rim 12 of bowl 4. Clamping flange 11 includes a planar top surface 13 and an overhang 14 projecting outward from rim 12 and encircling the top of bowl 4. Integrally attached to the underside of overhang 14 are several downward facing vertical threaded bolt receivers 18, or bosses, for receiving bolts that secure roof drain 1 to a roof. In a typical embodiment four bolt receivers 18 are formed in and equally spaced around the outside of bowl 4.

Roof drain 1 further includes a clamping ring 20 positioned above the top of clamping flange 11 for clamping flashing 21 therebetween. Clamping ring 20 comprises an annular band 22 having a band width and diameter similar to that of clamping flange 11. At the outer edge of annular band 22, a plurality of teeth 23 project perpendicularly upward from the band. Each tooth 23 is generally trapezoidal in shape and located longitudinally adjacent to another tooth 23 such that the gap between the teeth forms an inward sloping valley. This circular row of teeth lines the outer edge of annular band 22. Clamping ring 20 also comprises four equally spaced bolt support flanges 24 projecting inward from the annular band 22 with a bolt receiving slot 25 formed in and extending into each bolt support flange 24 from an inner end thereof.

Figure 4:
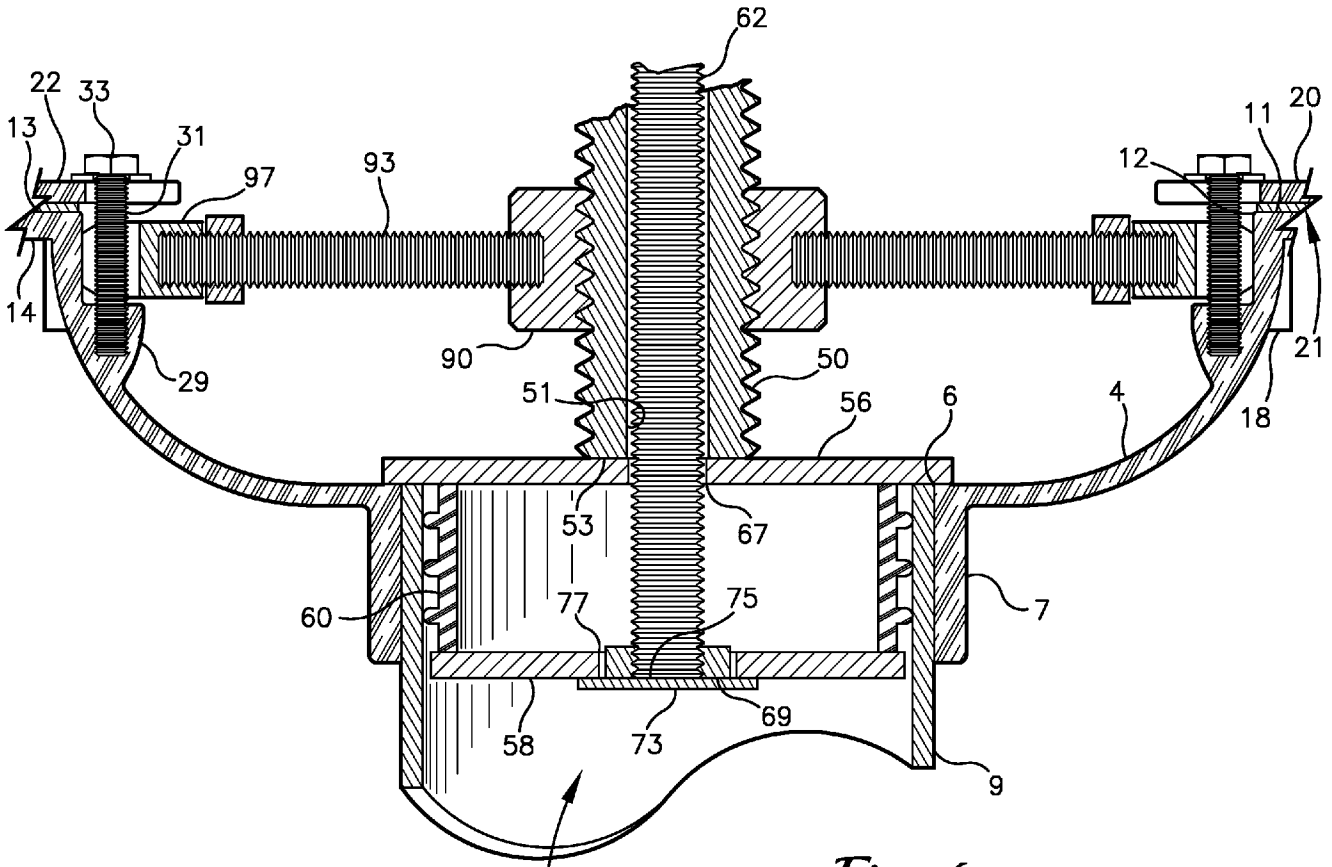
FIG. 4 is a fragmentary, cross-sectional view of the safety line anchor installed in a drain taken along line 4 of FIG. 1.

Roof drain 1 further comprises four upward facing vertical threaded clamping bolt receivers 29, or bosses, integrally formed on the interior wall of bowl 4. The clamping bolt receivers 29 are equally spaced about the interior circumference of the wall of bowl 4. The structure of each clamping bolt receiver 29 protrudes slightly into the interior space of bowl 4, and a threaded bore extending vertically through each clamping bolt receiver 29 is intended to align with one of the bolt receiving slots 25 when clamping ring 20 is placed atop clamping flange 11. Referring to FIG. 4, clamping ring 20 is fastened atop clamping flange 11 by positioning threaded stem 31 of clamping bolt 33 through receiving slots 25, and then threadingly securing the clamping bolts 33 in clamping bolt receivers 29. A strainer or grate, not shown, is typically secured over the rest of the drain assembly 1 shown. However, the strainer is removed prior to installation of the safety line anchor 2 therein. It is foreseen that other roof drain configurations may be used with the present invention, however the configuration described herein is thought to be the most common.

Figure 2:
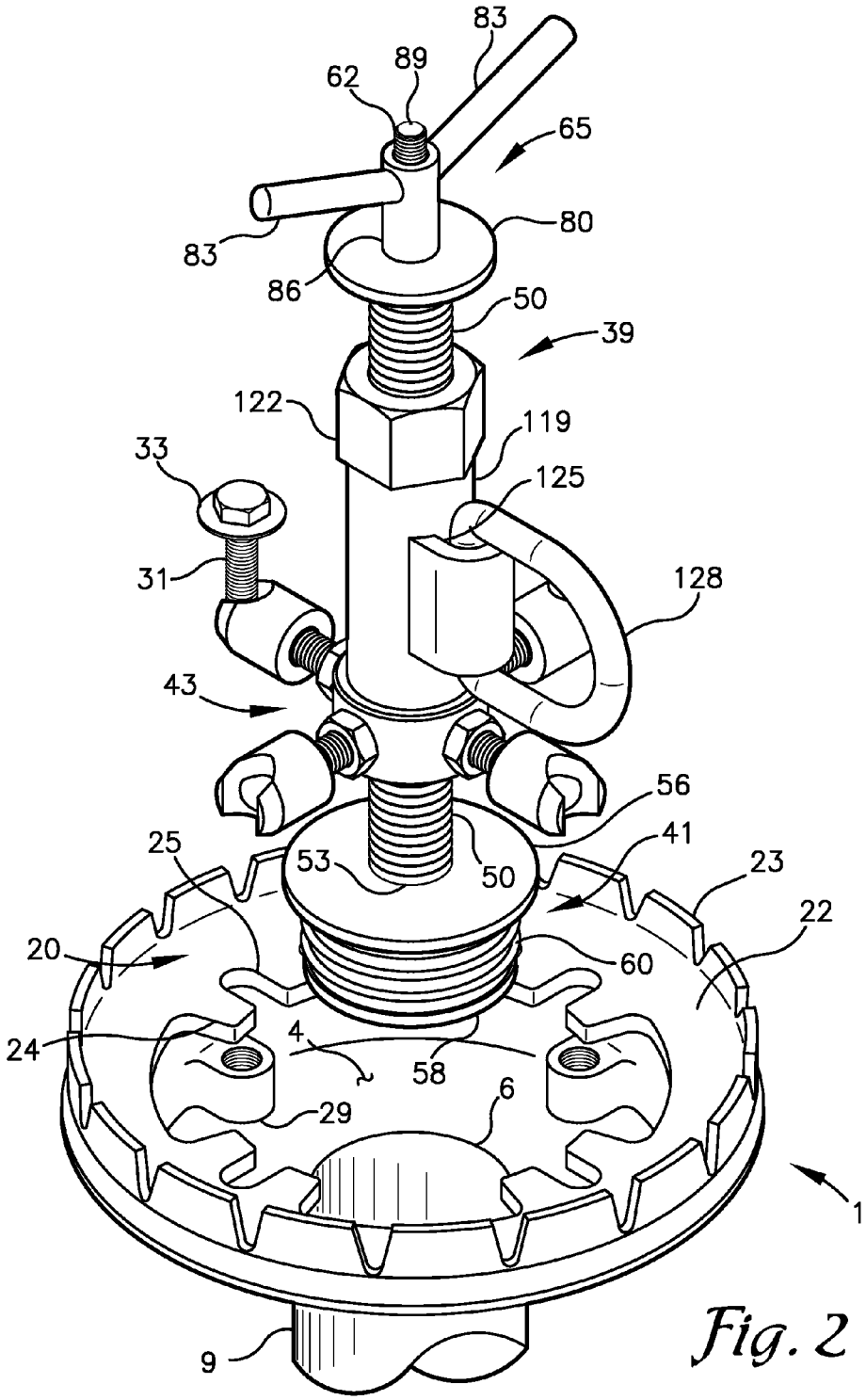
FIG. 2 is an exploded perspective view of the safety line anchor relative to a roof drain in which it is installed as shown in FIG. 1.
Figure 3:
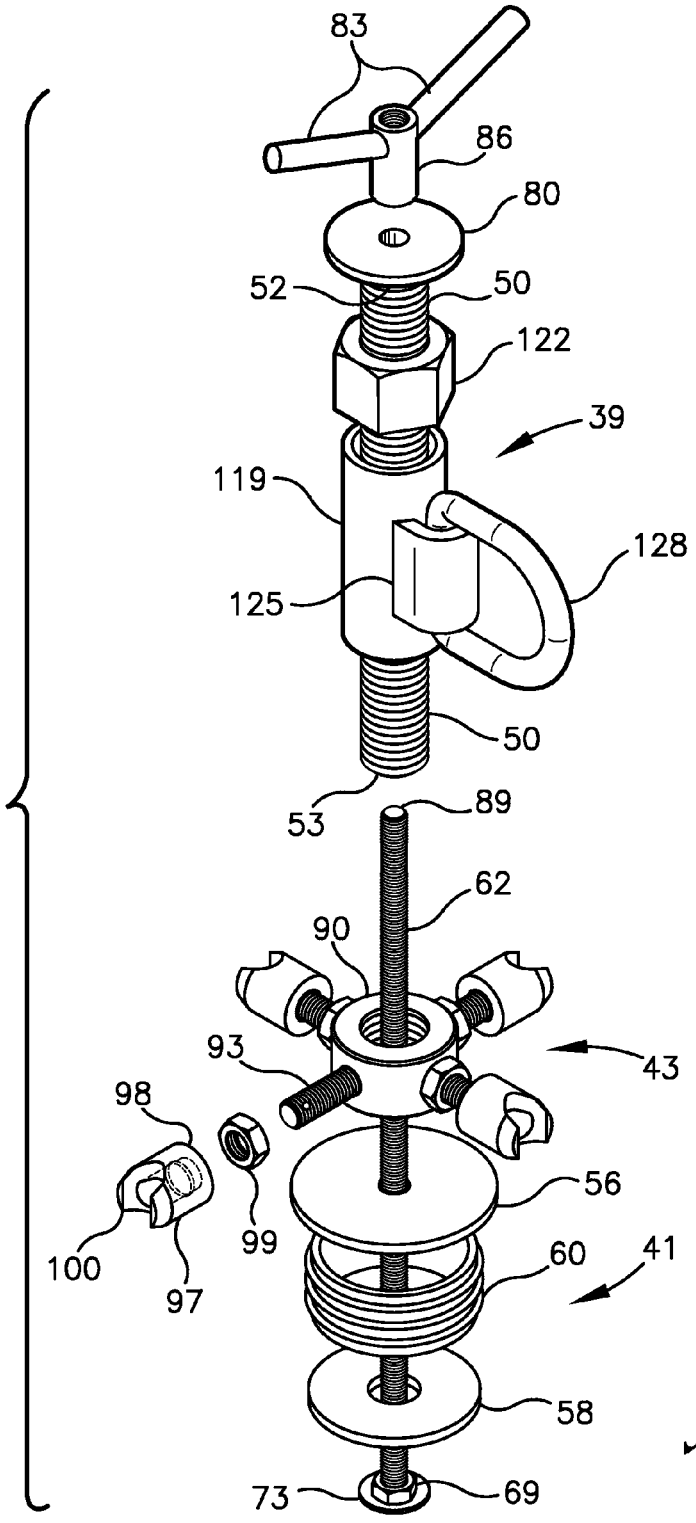
FIG. 3 is an exploded perspective view of the safety line anchor in FIG. 1.

As best seen in FIGS. 2 and 3, the safety line anchor 2 comprises an externally threaded anchor body or vertical stem 39, an expansion assembly 41, a drain coupling assembly 43, and a safety line connector assembly 45. The expansion assembly 41 is mounted on a lower end of the anchor body 39 and is sized for insertion into the upper end of the drain pipe 9 where it preferably aligns with drain neck 7 or within the neck 7 abutted against the upper end of pipe 9. Once inserted therein, the expansion assembly 41 may be expanded as described hereafter to restrain the vertical stem or body 39 from wobbling. The drain coupling assembly 43 is adapted to engage a portion of the drain 1 to prevent withdrawal of the anchor 2 from drain 1. The drain coupling assembly 43 is threadably mounted on the anchor body 39 to permit vertical adjustment of the drain coupling assembly 43 relative to the expansion assembly 41 to position the drain coupling assembly 43 in position to engage a portion of the drain 1. Safety line connector assembly 45, to which a safety line may be securely connected, is pivotally mounted on the anchor body 39.

In the embodiment shown, the body 39 comprises an externally threaded shaft or rod 50 with a bore 51 extending axially therethrough from end to end. The body 39 generally forms a base of the anchor 2 on which the other components are mounted. In one embodiment the shaft 50 is approximately twelve inches long or tall with an upper end 52 and lower end 53. It is foreseen that the shaft 50 could be longer or shorter.

The expansion assembly 41 which is connected to the lower end 53 of the shaft 50 generally comprise a top plate 56 adjacent the lower end 53 of shaft 50, a bottom plate 58, compression plug 60 positioned between the top and bottom plates 56 and 58, and a threaded rod 62 connected to the bottom plate 58 and extending through the anchor body 39 and connected to a wing nut or handle 65 positioned at the upper end 52 of shaft 50 for drawing the threaded rod 62 and attached bottom plate 58 upward to compress the compression plug 60 therebetween. The top plate 56 is annular with a hole 67 extending therethrough aligned with the axial bore 51 in shaft 50 and through which rod 62 extends. The top plate 56 generally rests on top of compression plug 60 which urges the top plate 56 into abutting relationship with the lower end 53 of the shaft 50. The top plate 56 is generally sized to be marginally larger than the largest drain pipe in which the safety line anchor 2 is intended to be installed. The hole 67 in top plate 56 is sufficiently large to allow top plate 56 to move freely along rod 62 but smaller than the diameter of anchor body 39 so that it cannot be slid past the anchor body 39.

Bottom plate 58 is an annular disc sized to be marginally smaller in diameter than the smallest drain pipe in which safety line anchor 2 is intended to be installed. Bottom plate 58 is immovably held in place with respect to rod 62 via a key nut 69 and a radial mounting flange 73, both of which have been fixedly attached, such as by welding, to the lower end 75 of rod 62. Mounting flange 73 is a circular disc approximately one-third the diameter of bottom plate 58. Fixedly attached to the top of mounting flange 73 is key nut 69 which is threadably engaged and fixedly attached to rod 62. A keyhole 77 shaped and sized to match the exterior perimeter shape of key nut 69 is created in bottom plate 58 proximate the plate's center. Bottom plate 58 is placed on key nut 69 by installing key nut 69 through keyhole 77 and then fixedly attaching bottom plate 58 to key nut 69. Key nut 69 is then fixedly attached to mounting flange 73, and the bottom plate 58, key nut 69, and mounting flange 73 assembly is fixedly attached to the lower end 75. Bottom plate 58, mounting flange 73 and key nut 69 are all immovable with respect to rod 62.

Resting on top of bottom plate 58 and below top plate 56 is compression plug 60. Compression plug 60 is a hollow cylindrical plug made of flexible and resilient material that returns to its fabricated or resting cylindrical shape after being deformed due to external forces. Compression plug 60 has ridges or other texture on the exterior surface of its cylindrical walls that aid in gripping the interior walls of the roof drain pipe 9 or roof drain neck 7. Threaded rod 62, which is longer than anchor body shaft 50, extends through the hollow cylindrical space inside compression plug 60, through the hole 67 in top plate 56, through axial bore 51 in anchor body shaft 50 and through wing nut or handle 65 positioned above the upper end 52 of anchor body shaft 50. Fixedly attached to the upper end 52 of shaft 50 is a circular support plate 80 against which the handle or wing nut 65 bears.

Handle 65 generally comprises two outwardly projecting grips 83 attached to an internally threaded cylindrical nut or sleeve 86. Each grip 83 is attached to the outer wall of nut 86 and arranged such that it extends away from nut 86 at an angle slightly above horizontal. Handle 65 is threaded onto an upper end 89 of rod 62 and into engagement with the support plate 80. Further axial rotation of handle 65 about rod 62 and against support plate 80 draws the rod 62 up through nut 86 drawing bottom plate 58 upward toward top plate 56 compressing the compression plug 60 therebetween causing it to expand outward to engage an inner surface of a pipe 9 or neck 7 in which it is installed.

The drain coupling assembly 43 includes an internally threaded collar 90 threadably engaged with shaft 50 above top plate 56 of expansion assembly 41. Collar 90 is vertically adjustable to accommodate differences in the depths of drains 1 with which it might be used and the location of the clamping bolts 33 and clamping bolt receivers 29 in such drains 1. Attached to the exterior of collar 90 are four equally spaced threaded studs 93 projecting radially outward therefrom. Slidably mounted on each stud 93 is a bolt engaging member or forked collar 97 which slides axially along the stud 93. Forked collar 97 has a generally cylindrical shape with a first end 98 that is flat and faces collar 90, and a second opposing end 100 that is forked resulting in two prongs 101 and a valley 102 therebetween formed by groove 103. The forked collars 97 are adapted to engage or surround either clamping bolts 33 or clamping bolt receivers 29 depending upon the specific configuration of roof drain 1. When safety line anchor 2 is installed, prongs 101 wrap around the vertical sides of bolt 33 or bolt receiver 29, and the bolt or receiver rests in or as near as possible to the fork valley 102. Forked collar 97 is pushed against bolt 33 or bolt receiver 29 and held in place by a jam nut 99 threadably engaged with stud 93 and abutting the first end 98 of the forked collar. When forked collar 97 is in place against bolt 33 or receiver 29 and jam nut 95 is threadably secure against forked collar 97 lateral movement of stud 93 is eliminated. Because lateral movement of stud 93 is eliminated, rotational movement of collar 90 is also eliminated. When forked collar 97 is engaged with bolt 33 or bolt receiver 29 the collar 90 is also trapped under clamping ring 20 thus also minimizing vertical movement of forked collar 97, stud 93, and collar 90 and preventing pulling of the safety line anchor 2 from the drain 1.

Implanted in stud 93 is a ball detent or position retaining device 104 comprising a pocket 105, spring 107, ball 110, and lip 112. Position retaining device 104 keeps forked collar 97 from accidentally sliding off of stud 93 and potentially falling into roof drain 1 and the associated roof drain system piping 9. Within pocket 105 is a spring 107 in a state of compression and a ball 110 located next to the first end of spring 107. The second end of spring 107 presses against the interior surface of the floor of pocket 105. Ball 110 is pressed by spring 107 against the circumferential lip 112 of pocket 105. A portion of ball 110 is allowed to protrude slightly above lip 112, however the majority of ball 110 is retained by lip 112 within pocket 105. A small threaded bore 114 is created perpendicular to and through the axis of stud 93 proximate its unattached end, and pocket 105 is threadingly inserted into bore 114 such that lip 112 is generally level with the threaded surface of stud 93. When pocket 105 is in place within bore 114, a portion of ball 110 projects slightly above the threaded surface of stud 93. A circumferential channel 116 is formed in the interior wall of forked collar 97 proximate first end 98. Channel 116 is sized to receive the portion of ball 110 projecting above the threaded surface of stud 93. As forked collar 97 slides axially along stud 93, the interior surface of forked collar 97 presses ball 110 down such that the outside of ball 110 is generally even with the threaded surface of stud 93. When forked collar 97 moves axially outward along stud 93 far enough that channel 116 is over ball 110, ball 110 projects upward into channel 116 due to the compression force of spring 107. When ball 110 is in channel 116 the ball catches the wall of channel 116 and discourages further outward movement of forked collar 97.

The safety line connector assembly 45 comprises a cylindrical sleeve or pivot sleeve 119 surrounding shaft 50, and the length of the pivot sleeve 119 shown is approximately half the length of shaft 50. Pivot sleeve 119 rotates freely around shaft 50 and its vertical position along shaft 50 is adjustable. A lower end of the pivot sleeve 119 is supported on the drain coupling assembly 43, and an upper stop or stop nut 122 threaded onto shaft 50 may be threaded against an upper end of the pivot sleeve 119 to fix its vertical position relative to the shaft 50. Stop 122 serves to limit the distance that sleeve 119 can travel vertically upward along shaft 50. Pivot sleeve 119 is confined to a zone of travel along shaft 50 that is bounded by upper stop 122 and collar 90. This zone of travel is adjustable by the user by adjusting the position of upper stop 122 and collar 90 relative to shaft 50. It is likely that the user will want to minimize the zone of travel when the safety line anchor 2 is in use so that there is minimal movement of sleeve 73. Connected to pivot sleeve 119 via mounting knuckle 125 is a d-ring 128, which is used for connecting a safety line 130 to the safety line anchor 2. Mounting knuckle 125 is in the form of a barrel hinge that surrounds the straight leg of d-ring 128 such that the ring can rotate freely about the axis of the straight leg. D-ring 128 also serves as a handle for transporting the safety line anchor 2.

Prior to installation of the safety line anchor 2, the jam nuts 99 are threaded back towards the collar 90 and the bolt engaging members 97 are pulled toward the collar 90 so that the drain coupling assembly 43 may be inserted in the drain 1 past the clamping ring 20. The handle 65 is loosened so that the bottom plate 58 is advanced far enough away from the top plate 56 so that the top and bottom plates 56 and 58 do not compress the compression plug 60. The stop nut 122 is threaded upward on shaft 50 so that the safety line connector assembly 45 and the drain coupling assembly 43 can be moved upward on shaft 50 to adjust the position of the drain coupling assembly 43 to align with the portion of the drain 1 to which it is to be connected.

To install the safety line anchor 2, the expansion assembly 41 is inserted into drain pipe 9, or drain neck 7 depending on drain configuration, with the top plate 56 resting on the bottom of the bowl 4 around the opening 6. The handle 65 of the expansion assembly 41 may then be rotated to draw the rod 62 upward, pulling the bottom plate 58 upward toward top plate 56 compressing the compression plug 60 therebetween and causing it to expand outward to engage the pipe 9 or drain neck 7 depending on the drain installation. Engagement of the pipe 9 or neck 7 by compression plug 60 steadies the anchor 2 from wobbling.

The vertical position of the drain coupling assembly 43 is then adjusted to align the bolt engaging members 97 with the clamping bolts 33 (or bolt receivers 29 if applicable) of the drain 1. Vertical adjustment of the drain coupling assembly 43 is accomplished by rotating threaded collar 90 relative to threaded anchor body 30. The bolt engaging members are each slid outward on the associated stud 93 until the prongs 101 surround the respective bolt 33 or bolt receiver 29 below the bolt support flange 24 and then the jam nuts 99 are threaded outward on studs 93 to prevent retraction of the bolt engaging members 97. Stop nut 122 is then threaded down onto pivot sleeve 119 of the safety line connector assembly 45 to fix its vertical position and a safety line 130 may then be connected to the D-ring 128 and the safety line anchor system is ready for use.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

Having thus described the invention, what is claimed as new and desired to be secured by this Patent is as follows:

1. A safety line anchor removably securable within a roof drain, the roof drain including a neck connectable to a drain pipe and a bowl projecting outward from the neck, the bowl includes a clamping flange projecting outward from an upper end thereof and a plurality of bolt receivers formed in the bowl, the roof drain further including a clamping ring connectable to the bowl over the clamping flange by bolts extending into the bolt receivers formed in the bowl, wherein a roof membrane is clamped between the clamping ring and the clamping flange, the safety line anchor comprising:

a body having an upper end and a lower end;

an expansion assembly mounted on a lower end of said body, said expansion assembly sized to fit within the neck of the roof drain or within the drain pipe to which the neck is connected prior to expansion, said expansion assembly expandable radially outward and sized to frictionally engage an inner surface of the neck or the drain pipe upon expansion;

a drain coupling assembly comprising a hub mounted on said body and vertically adjustable relative to said expansion assembly, said drain coupling assembly including at least one drain engaging member, said drain engaging member adjustable outward relative to said hub to at least partially surround one of the bolts or bolt receivers of the roof drain; and a safety line connector configured for connection of a safety line thereto, said safety line connector connected to said body.

2. The safety line anchor as in claim 1 wherein said body comprises an outer rod having an upper end and a lower end, an external thread and a bore extending therethrough along a vertical axis; said body further comprises an inner rod having an upper and a lower end and an external thread and sized longer than and smaller in diameter than said outer rod with said inner rod extending through the bore of said outer rod.

3. The safety line anchor as in claim 1 wherein said drain engaging member comprises one of a plurality of drain engaging members and each of said drain engaging member is supported on a threaded stud projecting radially outward from said hub and a jam nut mounted on each threaded stud is threadably adjustable relative to the threaded stud to adjust the radially outward positioning of the drain engaging member.

4. The safety line anchor as in claim 2 wherein said safety line connector includes a sleeve rotatably mounted around said outer rod above said hub.

5. The safety line anchor as in claim 4 wherein said safety line connector further comprises a ring connected to said sleeve.

6. The safety line anchor as in claim 2 wherein said expansion assembly expands radially outward upon drawing of said inner rod upward relative to said outer rod.

7. The safety line anchor as in claim 2 wherein said expansion assembly comprises an upper compression plate connected to said lower end of said outer rod and a lower compression plate fixedly connected to said inner rod proximate said lower end thereof.

8. The safety line anchor as in claim 2 further comprising a nut threadably coupled to said inner rod above said outer rod, said nut acting against said outer rod for drawing or driving said inner rod upward or downward relative to said outer rod.

9. The safety line anchor as in claim 3 further comprising a means for stopping said drain engaging member from sliding off of said threaded stud.

10. The safety line anchor as in claim 7 wherein said expansion assembly comprises an elastomeric compression plug positioned around said inner rod and between said upper and lower compression plates; wherein drawing of said inner rod upward draws said lower compression plate upward relative to said upper compression plate and said elastomeric compression plug, compressing said elastomeric compression plug and causing it to expand radially outward.

11. A safety line anchor removably securable within a roof drain, the roof drain including a neck connectable to a drain pipe and a bowl projecting outward from the neck, the bowl includes a clamping flange projecting outward from an upper end thereof and a plurality of bolt receivers formed in the bowl, the roof drain further including a clamping ring connectable to the bowl over the clamping flange by bolts extending into the bolt receivers formed in the bowl, wherein a roof membrane is clamped between the clamping ring and the clamping flange, the safety line anchor comprising:

an outer rod having an upper end and a lower end, an external thread and a bore extending therethrough along a vertical axis;

an inner rod having an upper and a lower end and an external thread and sized longer than and smaller in diameter than said outer rod with said inner rod extending through the bore of said outer rod;

an expansion assembly mounted on said lower end of said outer rod and connected to said inner rod, said expansion assembly expandable radially outward upon drawing of said inner rod upward relative to said outer rod; said expansion assembly sized to fit within the neck of the roof drain or within the drain pipe to which the neck is connected prior to expansion and said expansion assembly sized to frictionally engage an inner surface of the neck or the drain pipe upon expansion;

a drain coupling assembly comprising a hub secured around and vertically adjustable relative to said outer rod and a plurality of drain engaging members connected to said hub, each said drain engaging member radially adjustable outward relative to said hub to at least partially surround one of the bolts or bolt receivers of the roof drain;

a sleeve rotatably mounted around said outer rod above said hub; and a ring connected to said sleeve and configured for connection of a safety line thereto.

* * * * *